United States Patent [19]

Crosby

[11] 3,991,521

[45] Nov. 16, 1976

[54] WINDOW SASH HOLDER

[76] Inventor: Bing Crosby, P.O. Box 14885, Long Beach, Calif. 90814

[22] Filed: Feb. 17, 1976

[21] Appl. No.: 658,290

[52] U.S. Cl. ..... 49/417

[51] Int. Cl.[2] ..... E05D 13/08

[58] Field of Search ..... 49/417, 451, 414, 415, 49/437

[56] References Cited

UNITED STATES PATENTS

| | | | |
|---|---|---|---|
| 2,446,014 | 7/1948 | Larson | 49/417 X |
| 2,480,476 | 8/1949 | Johnson | 49/417 X |
| 2,543,913 | 3/1951 | Krouse | 49/437 X |

*Primary Examiner*—Philip C. Kannan

*Attorney, Agent, or Firm*—Fulwider, Patton, Rieber, Lee & Utecht

[57] ABSTRACT

A holder adapted to develop a frictional resistance between a sash and a window frame sufficient to hold the sash in a selected position, but insufficient to prevent the sash from being raised or lowered. The sash holder includes a bracket for attachment to the upper corner of the sash, a vertical leg of the bracket extending downwardly between the sash and the window frame. A threaded receptacle forming part of the bracket is expanded by threading a screw into it from the top of the window sash. This urges the bracket vertical leg against the window frame to develop the desired frictional resistance to movement of the sash.

1 Claim, 4 Drawing Figures

WINDOW SASH HOLDER

BACKGROUND OF THE INVENTION

1. Field of the Invention

The present invention relates to a window sash holder for sashes slidable in a window frame.

2. Description of the Prior Art

Most conventional sash windows, and particularly those made of wood, are held in position by counterbalancing mechanisms, such as sash weights housed in the window frame structure and connected to the window by sash cords, or preloaded springs housed in the window frame structure and connected to the window by wire cables. Such holders often become inoperative after a long period of use because of failure of the sash cords or sash cables. The lower sash then will no longer remain open and the upper sash will not stay closed.

Heretofore repair or replacement of the sash holder mechanisms has been expensive and time consuming. Although a number of devices have been proposed in the prior art in substitution for or in replacement of sash holders that have failed in this way, such devices have not been completely satisfactory. Often they are expensive, complex, or difficult to install and maintain.

SUMMARY OF THE INVENTION

According to the present invention, a window sash holder is provided which is inexpensive to manufacture, easy to install and maintain, and simple to adjust for ease of operation. The holder comprises a right angular bracket having a horizontal leg adapted to be attached to the upper horizontal portion of the sash adjacent one corner thereof. A vertical leg depends between the window frame and the sash, being adapted to extend into the groove provided in the sash to accommodate sash cables or cords.

The bracket includes a threaded expansible receptacle which receives a threaded element. Rotation of the threaded element expands the receptacle and urges the vertical leg of the bracket into frictional engagement with the adjacent window frame.

The sash holder, or pair of such holders, is relatively easily installed on the sash without removing the sash from the window frame, and without having to cut away or otherwise alter the structure of the sash or the window frame. The threaded element is located at the top of the sash so that it is readily accessible for adjustment of the frictional restraint upon the sash. In addition, the sash holders are adapted for use with either or both the upper and the lower sashes.

Other objects and features of the invention will become apparent from consideration of the following description taken in connection with the accompanying drawings.

DESCRIPTION OF THE PREFERRED EMBODIMENT

Figure 1:
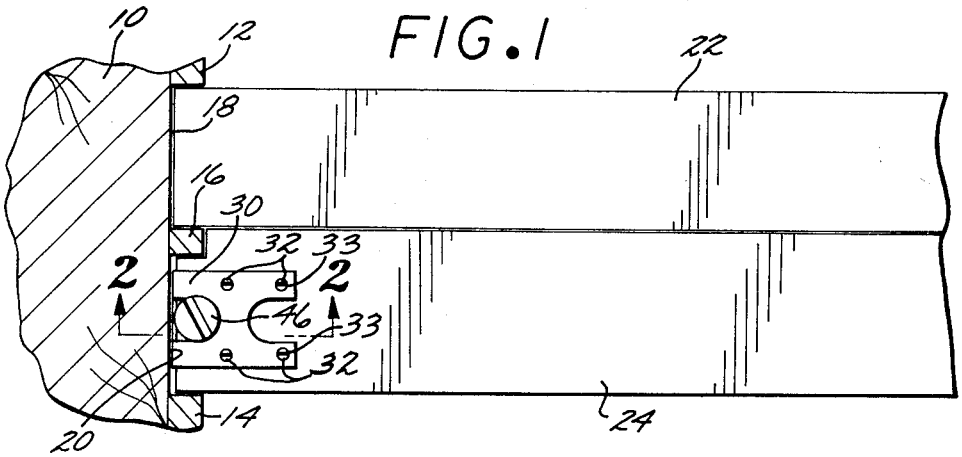
FIG. 1 is a top plan view, partially in cross section, showing the sash holder of the present invention installed at the upper left corner of a lower window sash.

Referring now to the drawings, there is illustrated, generally, a window frame 10, including vertically oriented conventional stop strips 12 and 14 and a central parting strip 16. These strips define a pair of vertical channels 18 and 20 within which an upper window sash 22 and a lower window sash 24 are vertically slidable, respectively. For brevity, only portions of the window frame 10 and sashes 22 and 24 are illustrated.

Although installation of a single sash holder 26 at the upper left corner of the lower sash 24 will be described, two of the holders 26 are preferably utilized, one at each of the upper corners of the sash 24. Similarly, where the upper sash 22 is to be provided with holders 26, it is preferred to use one at each of the upper corners of the sash 22, which necessitates pulling the sash 22 partially downwardly to afford access to the corners, as will be apparent.

As previously indicated, inoperativeness of the sashes 22 or 24 is commonly occassioned by failure of originally installed sash cords or cables. Any protruding portions of such cords or cables are cut away before installation of the present sash holder 26 is attempted. However, it is not necessary to remove the sash weights or counterbalancing spring structure. It is simply left where it is installed in the window frame.

Although the sash holders 26 are herein described as relacements for counterbalance mechanisms which have failed, it will be apparent that the holders 26 are also adapted for installation as original equipment at the time the window structure is first fabricated.

The sash holder is fitted to the upper left corner of the sash 24 by placing it on top of the sash with a vertical leg of the holder extending downwardly into the old sash cord groove 28 or similar opening. More particularly, the holder 26 comprises a generally right angular bracket having a horizontal leg 30 and a vertical leg 32. The leg 30 is adapted to be attached to the horizontal upper portion of the sash 24 by four conventional wood screws 32 extending through openings 33 provided in the leg 30. The bracket is preferably made of metal for durability and resilience, although it can be made of any suitable material. It is conveniently stamped out of a flat metal blank 36, as best seen FIG. 4. The vertical leg 34 is formed by bending the blank along the line indicated at 38.

Figure 2:
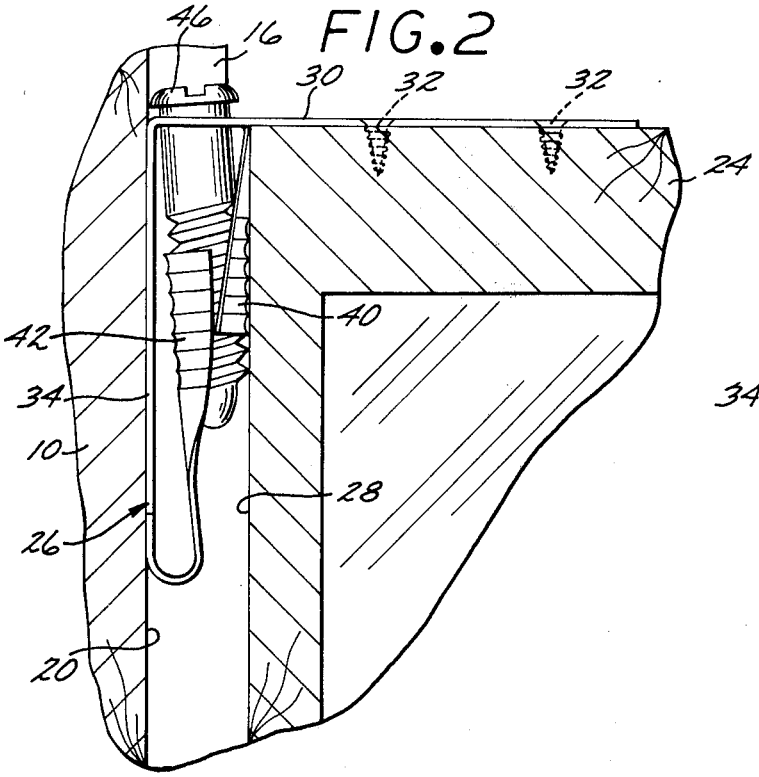
FIG. 2 is an enlarged view taken along the line 2—2 of FIG. 1.

As seen in FIG. 2, the holder is disposed in position such that the vertical leg 34 depends between the window frame 10 and the sash 24 within the old sash cord groove 28. In this position the vertical leg 34 is normally frictionally engaged upon the frame 10.

Figure 3:
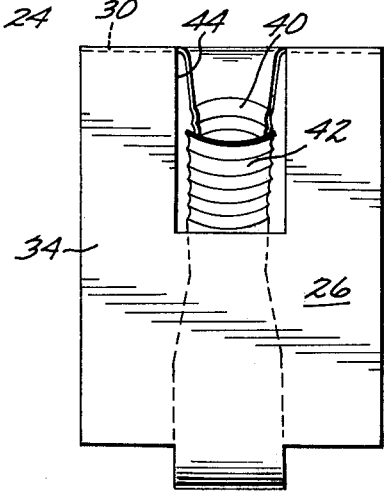
FIG. 3 is a left side elevational view of the present sash holder.
Figure 4:
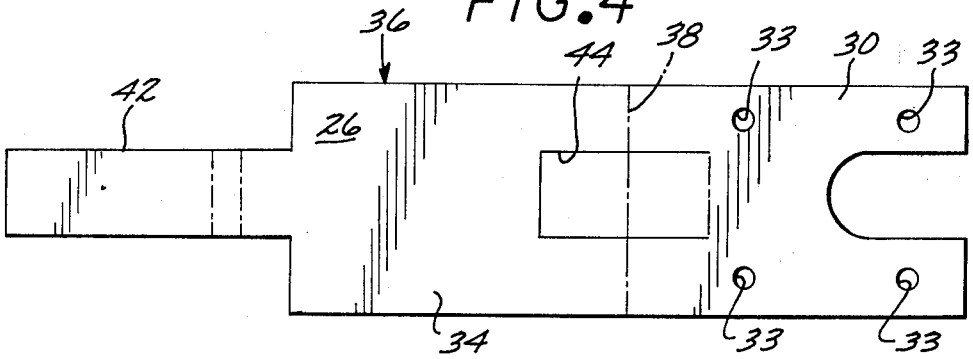
FIG. 4 is a top plan view of the flat blank from which the sash holder is formed.

The holder 26 also includes threaded expansible receptacle means located adjacent the vertical leg 34, and defined by confronting inner and outer threaded portions 40 and 42. The inner portion 40 is punched or formed out of the blank 36, leaving a rectangular opening 44, as seen in FIG. 4. In addition, the inner portion 40 is formed into a generally semi-circular configuration having integral threads, as best seen in FIGS. 2 and 3.

The outer portion 42 is characterized by a similar semi-cylindrical or arcuate configuration having integral threads. It is formed as a reversely bent, continuation of the vertical leg 34, extending upwardly to locate the portions 40 and 42 in closely adjacent relation.

The adjacent portions 40 and 42 define a threaded, two-part expansible receptacle adapted to threadably receive a threaded element or slotted screw 46. The screw 46 extends downwardly through the opening 44 and is rotated in one direction for threaded movement downwardly to bias the outer portion 42 away from the inner portion 40. This in turn biases the vertical leg 34 into greater frictional engagement with the window frame channel 20. The degree of friction is easily adjusted by rotation of the screw 46 so that is is sufficient to hold the sash 24 in any desired position, but insufficient to offer significant resistance to deliberate raising and lowering of the sash.

From the foregoing it will be apparent that no alteration of the existing window frame or sash structure is necessary to install the present sash holders. The simple construction of the holder makes it relatively easy and inexpensive to manufacture, and the few operating parts provide reliable and maintenance free operation.

Various modifications and changes may be made with regard to the foregoing detailed description without departing from the spirit of the invention.

I claim:

1. A window sash holder for sashes vertically slidable in a window frame, said holder comprising:

a unitary, generally right angular bracket formed out of sheet material and including an integral horizontal leg adapted to be attached to the horizontal upper portion of the sash adjacent one corner thereof and thereby forming the sole attachment means securing said bracket to the sash, said bracket further including an integral vertical leg adapted to depend between the window frame and the sash for frictional engagement with the window frame, said horizontal and vertical legs including an inner portion formed out of said material and extending downwardly from said horizontal leg, said inner portion having partial threads formed therein, the free extremity of said vertical leg being reversely formed to extend upwardly and thereby define an outer portion located in confronting relation to said inner portion, said outer portion having partial threads formed therein whereby said inner and outer portions define a threaded receptable means; and a threaded element disposed within said receptacle means and adapted upon threaded movement downwardly to urge apart said inner and outer portions and thereby bring said outer portion into greater frictional engagement with the window frame.

* * * * *